US006560911B2

(12) United States Patent
Sharp

(10) Patent No.: US 6,560,911 B2
(45) Date of Patent: May 13, 2003

(54) ADJUSTABLE GUN STOCK

(76) Inventor: Ronnie L. Sharp, 504 Maple St., Nampa, ID (US) 83686

( * ) Notice: Subject to any disclaimer, the term of this patent is extended or adjusted under 35 U.S.C. 154(b) by 0 days.

(21) Appl. No.: 10/012,784

(22) Filed: Nov. 5, 2001

(65) Prior Publication Data

US 2002/0050088 A1 May 2, 2002

Related U.S. Application Data

(63) Continuation-in-part of application No. 09/414,827, filed on Oct. 6, 1999.

(51) Int. Cl.[7] ..... F41C 23/14
(52) U.S. Cl. ..... 42/73; 42/72; 42/74; 42/94
(58) Field of Search ..... 42/72, 73, 74, 42/94

(56) References Cited

U.S. PATENT DOCUMENTS

| | | | | | |
|---|---|---|---|---|---|
| 2,462,091 | A | | 2/1949 | Garand | 42/72 |
| 3,256,632 | A | | 6/1966 | Beretta | 42/72 |
| 3,570,162 | A | | 3/1971 | Suddarth | 42/72 |
| 3,618,249 | A | | 11/1971 | Grandy | 42/73 |
| 4,327,626 | A | | 5/1982 | McQueen | 89/197 |
| 4,430,822 | A | * | 2/1984 | Fromming et al. | |
| 4,513,523 | A | | 4/1985 | Gal | 42/72 |
| H486 | H | * | 7/1988 | Savioli | |
| 4,878,305 | A | | 11/1989 | Gabrielidis | 42/72 |
| 5,305,539 | A | | 4/1994 | Von Kuster | 42/75.01 |
| 5,367,812 | A | * | 11/1994 | Lautrec | |
| 5,410,833 | A | * | 5/1995 | Paterson | |
| 5,711,102 | A | | 1/1998 | Plaster et al. | 42/71.01 |
| 6,289,622 | B1 | * | 9/2001 | Desch, Jr. et al. | |

* cited by examiner

*Primary Examiner*—Michael J. Carone
*Assistant Examiner*—John Richardson
(74) *Attorney, Agent, or Firm*—Pedersen & Co., PLLC; Ken J. Pedersen; Barbara S. Pedersen

(57) ABSTRACT

The present invention is an adjustable-length stock for a shoulder fired weapon, which preferably includes an extendible shoulder piece installed on a shortened gun stock. The extendible shoulder piece preferably includes a butt plate for placement against the shoulder of a user, and a telescoping connection between the butt plate and the shortened gun stock. The connection may have at least one support rod and preferably two support rods telescopically sliding within their respective support tubes. After adjustment, the stock is locked at the selected length, thereby fixedly holding a desired length. The preferred two connections between the butt plate and the gun stock are vertically-distanced as much as possible, in order to stabilize the butt plate. The system preferably also uses a bipod for forward support of the weapon while being used by the adolescent. This system may be used to teach adolescents how to fire such a weapon.

12 Claims, 8 Drawing Sheets

A1
A2
120
100
11
9
140
113
B1

A1
A2
L
120
18
100
22
29
9
11
130
119
101
117
12
4
140
135
115
113
B1

130
140
135

ADJUSTABLE GUN STOCK

This application is a continuation-in-part of U.S. patent application entitled "ADJUSTABLE GUN STOCK" Ser. No. 09/414,827, filed on Oct. 6, 1999, which application is incorporated herein by this reference.

BACKGROUND OF THE INVENTION

1. Field of the Invention

The present invention generally relates to gun stocks used with shoulder-fired weapon.

2. Related Art

Since the advent of shoulder-fired weaponry, such as guns, the use of a stock for holding the barrel and firing mechanisms of the weapon has been a standard practice. Typically, a stock made of wood, plastic, or metal extends rearward from the firing mechanism a certain distance, creating what is often referred to as a "gun butt" portion. This gun butt portion is used to stabilize the weapon by the user pressing the gun butt against his/her shoulder while aiming and firing the weapon.

Standard rifles and other shoulder-fired weapons customarily have stocks with a butt portion located a particular distance from the trigger, often referred to as a pull length. The pull length distance for the standard rifle is based on the arm length of an "average user." A difficulty arises when a user of size smaller than the hypothetical "average user" attempts to use such a weapon. The difficulty is due to the fact that for these smaller individuals, the butt portion of the stock, which is held against the front of the user's shoulder, is too far from the trigger for the user to comfortably reach the trigger and/or properly and safely operate the weapon.

What is needed is an adjustable gun stock and a system for allowing smaller gun users to operate such a firearm. A system is needed that would also allow the gun with adjustable gun stock to be adjusted so that an average size, or even larger-than-average size, user would also be able to use the weapon. There are various collapsible style gun stocks (U.S. Pat. No. 2,462,091; U.S. Pat. No. 3,256,632; U.S. Pat. No. 3,618,249; and U.S. Pat. No. 5,305,539) and at least one telescoping style gun stock (U.S. Pat. No. 3,570,162). None of these prior art devices allow for finite adjustment of the distance from the butt to the trigger. Such adjustments would allow the rifle or other weapon to be customized to a particular user's body frame. The present invention addresses these and other needs.

SUMMARY OF THE INVENTION

The present invention comprises an extendible shoulder piece for a weapon. Further, the invention may comprise a method of using this extendible shoulder piece within a shooting system for use by adolescents, and an invented bi-pod for use with a weapon that stabilizes the front end of the weapon.

The preferred embodiment of the extendible shoulder piece is added to the rearward end of a gun stock that is rearwardly-shortened. The weapon's "shortened stock" is shortened relative to the conventional "average" gun stock, either by removal of a rear portion of the conventional gun stock, or by fabrication of the gun stock during original manufacture to purposely be short. Alternatively, one may see that the extendible shoulder piece may also be molded, carved, or otherwise formed as an integral part of the gun stock, in the general location of, and replacing, a conventional gun butt. The preferred extendible shoulder piece is connected to the shortened gun stock just behind the grip portion of the stock, which is gripped by the user during shooting and which is adjacent to the weapon's trigger guard.

The invented shoulder piece has a butt plate, at its rearmost end, that has a generally vertical rear surface for abutting against the user's shoulder. The butt plate is adjustably connected to the shortened gun stock, preferably by means of a telescoping connection that can be securely locked and easily unlocked for adjusting the shoulder piece to fit various users. Preferably, the adjustable connection comprises an upper connector that extends longitudinally rearward from the shortened gun stock slightly below the longitudinal axis of the barrel and slightly below the sights of the gun. Preferably, the adjustable connection also comprises a lower connector that extends longitudinally rearward from the bottom end of the grip portion of the gun stock, so that the lower connector is distanced a maximum amount from the upper connector, to maximize the height of the extendible shoulder piece to stabilize the butt plate on the shoulder and to stabilize the butt plate relative to the connectors and the gun stock. By providing the maximally-spaced upper and lower connectors with a long butt plate (measured vertically between the top edge and the bottom edge of the butt plate) and by attaching the upper and lower connectors near the top edge and bottom edge of the butt plate, respectively, the forces exerted on the butt plate during use are less prone to pivot or leverage the butt plate off of the shoulder and less prone to damage or wear the invented shoulder piece and its connection to the gun stock by that same pivoting/leverage.

In some embodiments, maximizing the distance between the upper and lower connectors is also important for maximizing the open space between the upper connector and the lower connector that provides room for the user's hand. This way, the user's hand may extend into the open space for operating lock or latch mechanisms to adjust the shoulder piece, or, in some embodiments, may rest in part of the open space as part of the gripping action during shooting. In the preferred embodiment of the invention, the upper connector is a telescoping first tube system, and the lower connector is a telescoping second tube system. The first tube system extends rearward from the upper region of the grip portion of the gun stock, and the second tube system extends rearward from the lower extremity, that is, the lowermost end, of the lower region of the grip portion. In some embodiments, wherein the lower region of the grip portion is a hand-hold member that extends downward in a definite pistol-grip style (see FIG. 1), both the thumb and fingers would curl around the hand-hold member, and the thumb and part of the hand extends into the open space between the first tube system and the second tube system. In other embodiments of gun stocks, the grip portion curves downward and rearward in a more gradual and subtle manner that is called herein a non-pistol-style grip (See FIGS. 5A–8B), creating a different look and feel from the pistol grip. In the non-pistol-grip style, the user's thumb curls around the upper region of that grip portion, the user's fingers curls around the lower region, and no part of the user's hand needs to extend into the open space between the first tube system and second tube system. In the non-pistol-style grip, the first and second tube systems tend to be closer together than in the pistol-style grip. This is because the upper region (to which the first tube system is attached) and the lowermost extremity of the grip (to which the second tube system is attached) are not as far apart as in the pistol-style grip embodiments, and, also, there is no need for the hand to extend into the open space between the tube systems. Therefore, to increase the total height (vertical dimension) of the butt plate, the butt plate preferably extends down below the second tube system to increase butt plate length and total area of the rear surface of the butt plate.

Therefore, an objection of the invented extendible shoulder piece is to provide a more stable and reliable extendible gun stock that in prior art attempts at extending gun stocks. One way the invention accomplishes this is to adapt the shoulder piece for attachment to the short gun stock so that the upper connector is positioned to be below the barrel longitudinal axis of the weapon for being a cheek rest for a user. Further, the hand-hold member lower extremity and the lower connector extending rearward from the hand-hold member lower extremity are preferably positioned to be a lowermost extremity of the weapon, that is, the structure of the weapon that extends the farthest downward when the weapon is in the generally horizontal position as shown, for example, in FIG. 5A. In embodiments that include a butt plate that extends below the lower connector, the lower extremity of the hand-hold member and the lower connector extending rearward from the hand-hold member lower extremity are preferably the lowermost extremity of the weapon forward from the butt plate, that is, the lowermost extremity of the weapon except for the butt plate and any bipod or tripod.

Each telescoping tube system may comprise a support rod member sliding into a support tube member, and a lock for securing preferably each tube system. For example, the lock may comprise a thumb screw/set screw extending through an orifice in the support tube member to tighten down against the support rod member. The locks prevents collapse or extension of the tubes and rods in relation to each other as the weapon fires.

Optionally, the invented extendible shoulder piece is used on a firearm in combination with a support means for the front of the firearm. The preferred support means for the front of the firearm is a bipod of adjustable height. The combination of adjustable-height bipod and adjustable-length firearm stock allows an adult, instructing an adolescent in the proper firing of a weapon, to properly position the firearm so that the adolescent may fire it and both adult and adolescent may be more sure of a safe firearm operation.

Still other objects and advantages of the present invention will become readily apparent to those skilled in this art from the following detailed description wherein I have shown and described only preferred embodiments of the invention, simply by way of illustration of the best mode contemplated by carrying out my invention. As will be realized, the invention is capable of modification in various respects without departing from the invention.

DESCRIPTION OF THE PREFERRED EMBODIMENTS

Referring to the Figures, there are shown several, but not the only, embodiments of the invention. The extendible shoulder piece according to the invention adapts a gun stock to be adjustable to use by younger or smaller shooters and/or average-size users. Also, larger-than-average-size individuals may use the invented shoulder piece, because they wish to have an adjustable gun stock that allows them to extend the length of the weapon farther from their shoulder.

The present invention is an extendible shoulder piece for a weapon, and may optionally include a bipod for stabilizing the front/barrel of the weapon. Also included in the invention may be a method of using these features in a system to teach adolescents and others of smaller statute how to fire such a weapon. As used herein, "weapon" is intended to include all shoulder-fired weaponry including, but not limited to: military weaponry, rifles, shotguns, pellet guns, "BB" guns, firearms, paint guns, and crossbows.

Figure 7:
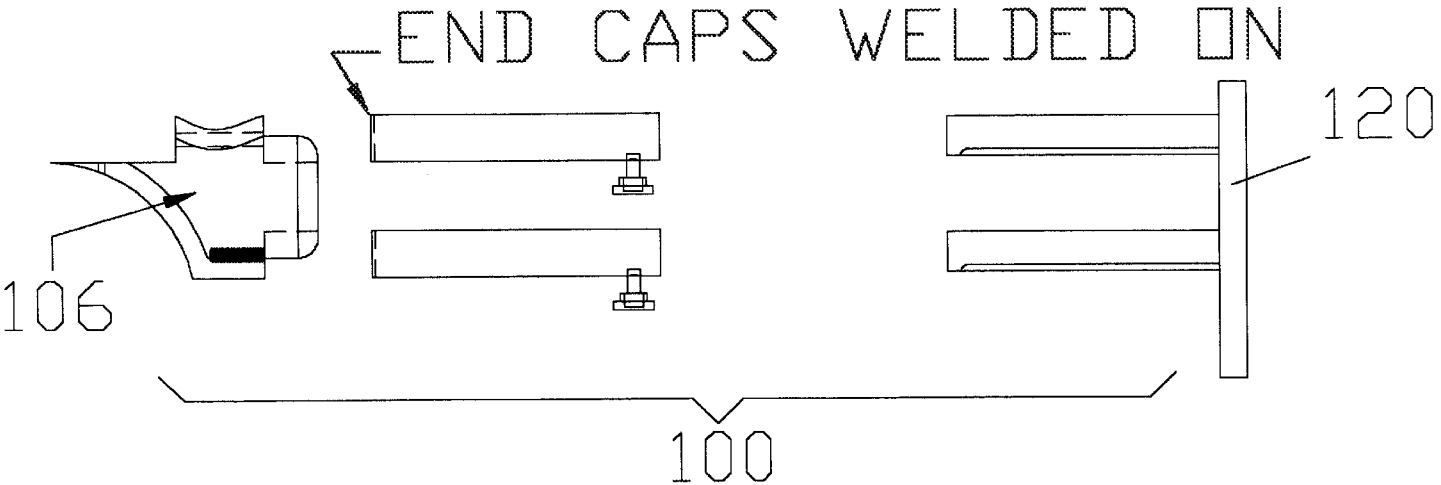
FIG. 7 is an exploded side view of the pieces-parts of the extendible shoulder piece of FIGS. 5A, 5B and 6, wherein the extendible shoulder piece is detached from the weapon.
Figure 8B:
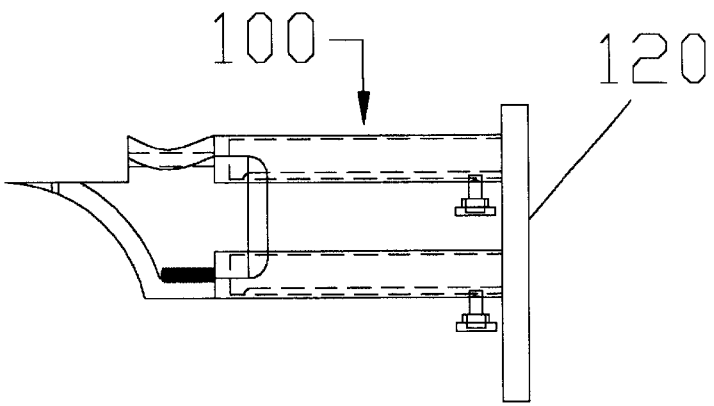
FIGS. 8A and 8B are side views of the extendible shoulder piece of FIGS. 5–7, shown in extended and retracted position, respectively.
Figure 8A:
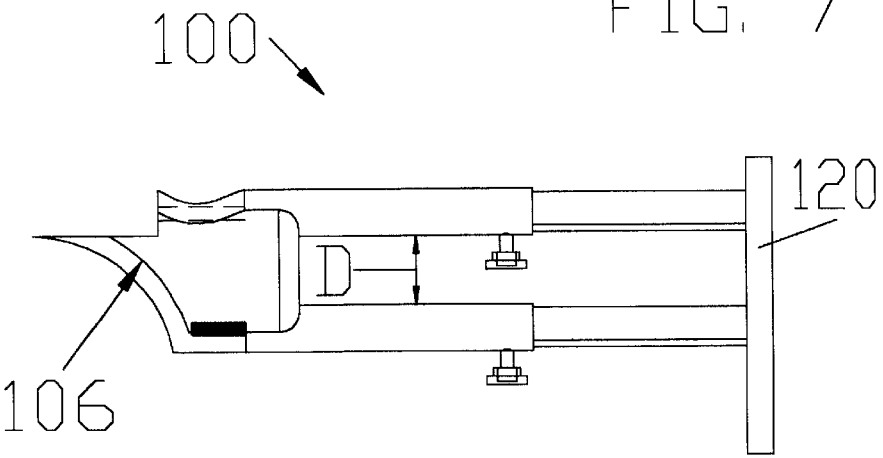
Figure 8C:
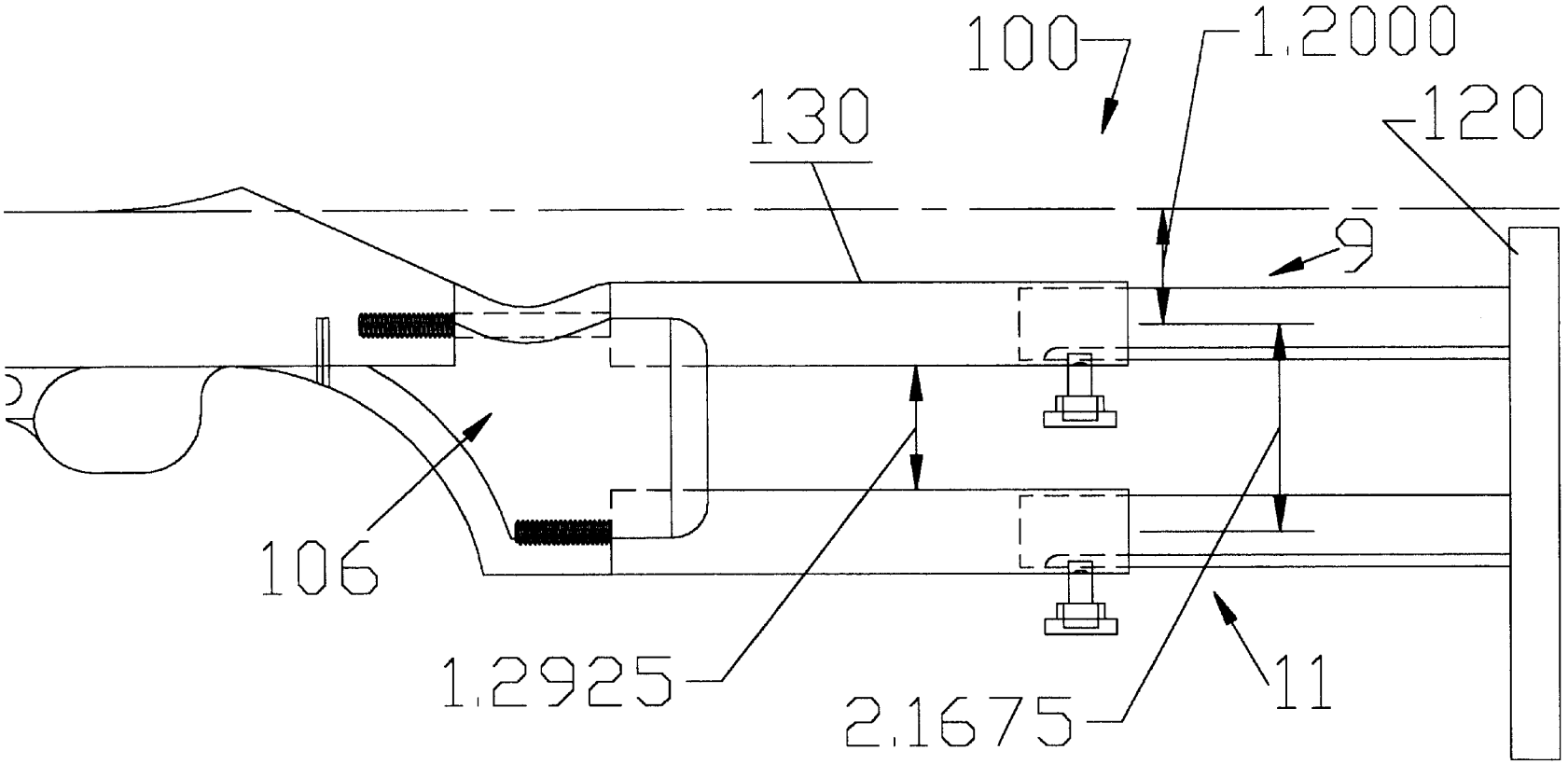
FIG. 8C is a side view of the rear of the weapon of FIGS. 5A–8B, showing preferred spacing of the telescoping connectors.

In FIGS. 1, 2, 5A, 5B, and 6, the invented extendible shoulder piece is shown connected to a weapon. In FIGS. 7 and 8A and 8B, a particularly-preferred shoulder piece according to the invention is shown detached from the shortened gun stock of the weapon. The extendible shoulder piece according to the invention may be provided as integrally included in a gun stock, or may be provided as a separate unit, such as in FIGS. 7, 8A, and 8B, that may be installed on a shortened gun stock by a gunsmith. The separate unit may installed on a gun stock by screws, bolts, glue and/or other means as may be understood by a gunsmith. The separate unit may consist of, for example, two telescoping, lockable tube systems plus a butt plate, and may be attached to a pre-existing grip portion of a shortened gun stock. Or, the separate unit may consist of, for example, a grip portion, two telescoping, lockable tube systems, and a butt plate, and may be installed on a shortened gun stock without a grip portion.

Figure 1:
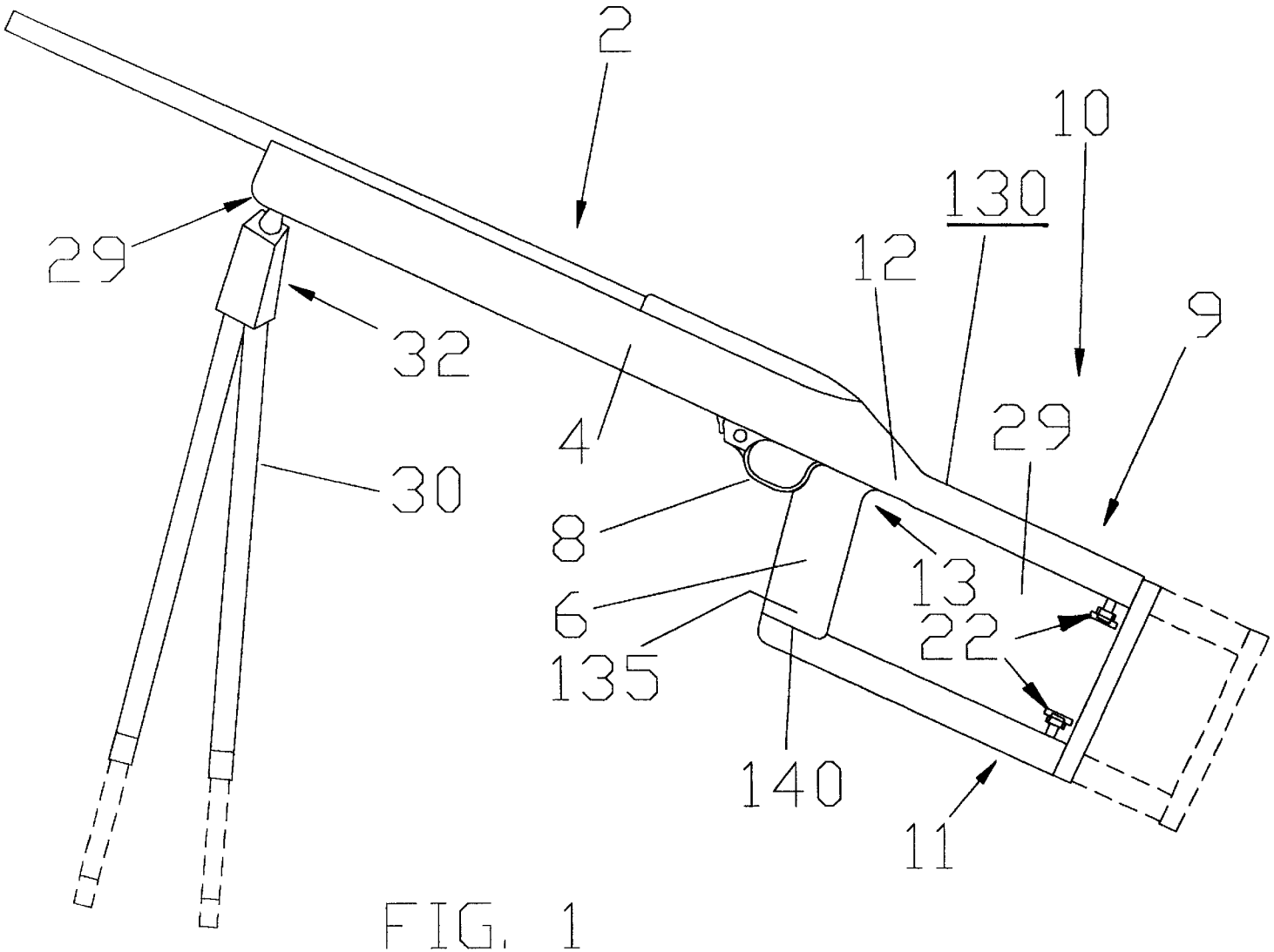
FIG. 1 is a perspective view of the one embodiment of the present invention, including weapon with the extendible shoulder piece and bipod.

FIG. 1 shows an embodiment of the present invention installed or provided integrally on a pistol-style grip firearm. In FIG. 1, we can see the extendible shoulder piece 10 extending from the rear of the stock 4. In this embodiment, the grip portion 13 comprises upper region 12 and lower region 6, wherein the lower region takes the form of a pistol-style hand-hold member extending generally downward from the rear end of the stock 4, preferably adjacent to trigger guard 8 extending from the lower surface of the stock 4. The extendible shoulder piece 10 comprises telescoping first tube system 9 and telescoping second tube system 11, with open space 29 in between said tube systems. Locks 22 are shown on both tube systems 9, 11. Also shown in FIG. 1 is bipod 30, the bipod legs of which are adjustable in length. This bipod 30 allows an undersized user to support and stabilize the front end 29 of the weapon.

Figure 2:
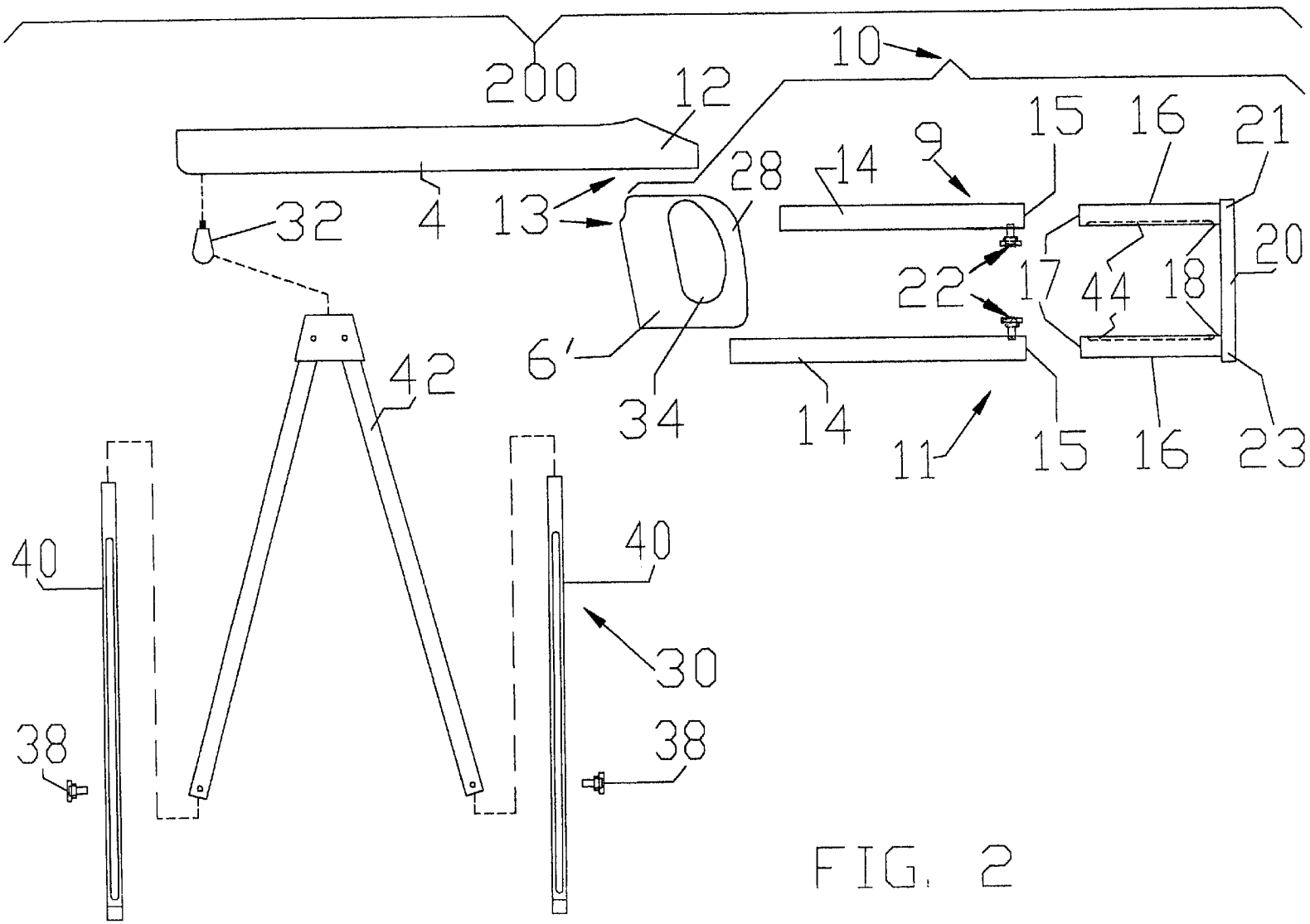
FIG. 2 is an exploded view of another embodiment of the present invention, including weapon with the extendible shoulder piece and bipod.

Now referring to FIG. 2, an alternative embodiment of a firearm with extendible shoulder piece and bipod 200 is shown in an exploded state. The stock 4 of the gun is a shortened version of a conventional gun stock, wherein the stock has been made short in original manufacture or later shortened by a gunsmith. In this embodiment, the stock's grip portion is formed by the attachment of the hand-hold member 6' to the rear end of the shortened stock, wherein hand-hold member 6' becomes the lower region of the grip portion and the rear end of the stock becomes the upper region 12 of the grip portion 13. In this embodiment, therefore, the lower region of the grip portion is supplied as part of the extendible shoulder piece. The first tube system 9 and second tube system 11 are each made of support tube 14 and a support rod 16 for telescoping cooperation within the support tube 14, preferably by means of the support rod 16 sliding into the support tube 14. The preferred rod 16 and tube 14 are made of steel, but may be made of various materials. The preferred hand-hold 6 is made of plastic but also may be made of various materials.

Locks 22 are preferably included on both first tube system 9 and second tube system 11, rather than being on only one of the tube systems. For alternative adjustable connections, other than a two-tube system, there are preferably as many locks as are needed to make the extendible feature very secure, so no movement/sliding of the shoulder piece takes place during the shock of firing. The locks 22, or other locking means installed on the shoulder piece, allow the user to fix the shoulder piece length into preferably an infinite number of lengths to adjust correctly for different user sizes. Alternatively, the invented shoulder piece may be made to adjust into many discreet, incremental lengths, but this is less-preferred.

Figure 3:
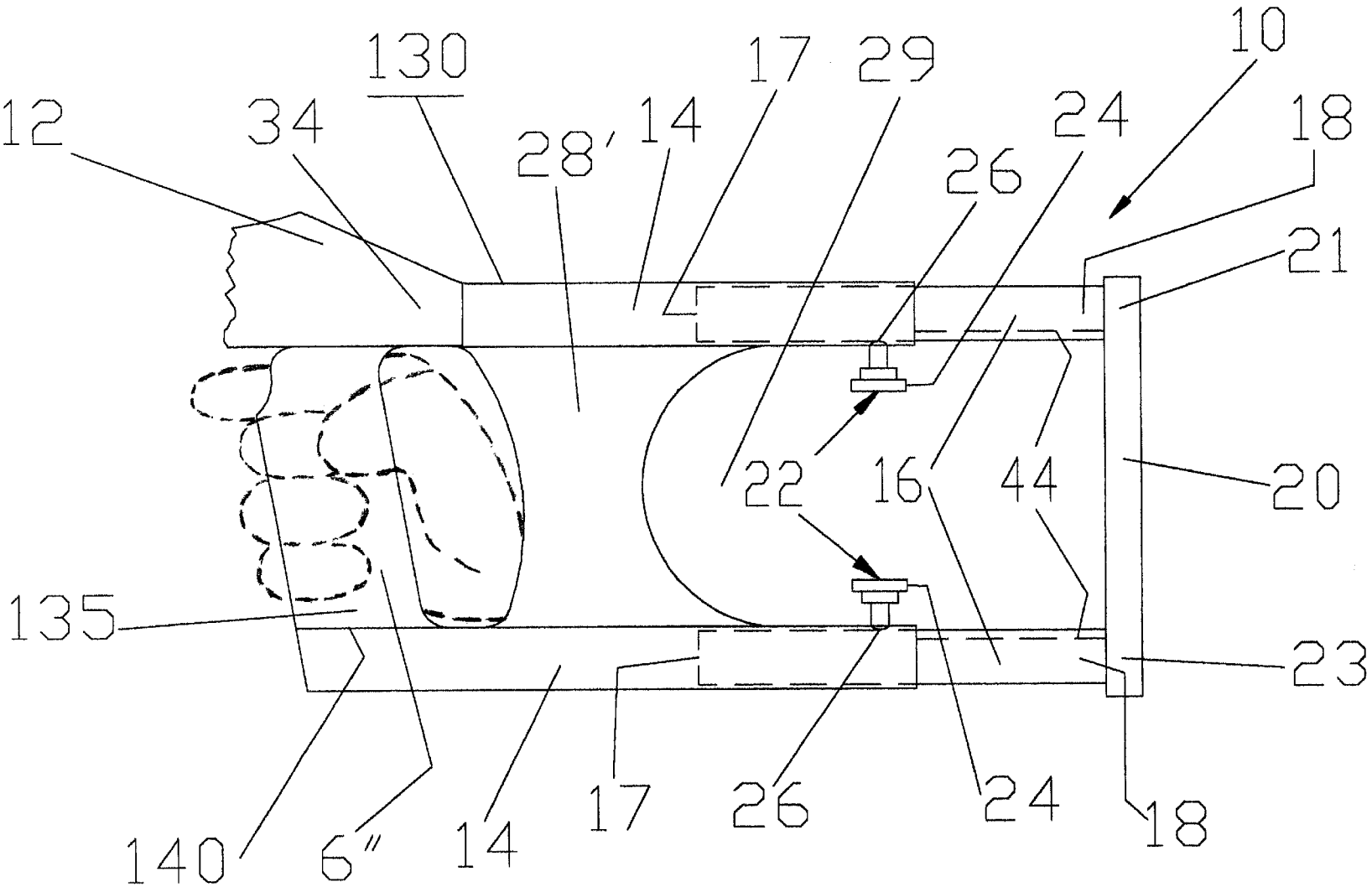
FIG. 3 is a side view of an alternative extendible shoulder piece.

A preferred lock 22 is shown in FIG. 3, and comprises a thumb screw 24 threadably installed in an an orifice 26 in the support tube 14, said screw 24 gripping against a groove 44 extending along the length of the support rod 16. Tightening down the screw 24 against the support rod 16 (preferably against groove 44) holds the rod within the tube. Because the groove 44 is preferably continuous and the screw 24 may be tightened down in the groove 44 anywhere along the groove, the adjustability of the telescoping members is continuous. This continuous adjustability provides smooth adjustment into an infinite number of locations, which is beneficial for adults working with young, growing users. The groove 44 terminates before the support rod first end 17, to provide a stop against which the thumb screw will abut to keep the rod 16 from accidentally being slid out of the tube 14. Detents (not shown) may further be located along the rod 16 for assisting in precise length measurement from leg to leg. All other attachment means are envisioned as long as each support tube can be fixed and unfixed on its respective support rod. It is envisioned that alternative versions of locking means may be used.

FIG. 3 illustrates an extendible shoulder piece quite similar to that in FIG. 2, except that the rigidizing member behind the thumb hole 34 is an insert 28', rather than being integrally included in the hand-hold 6. In FIG. 3, the pieces-parts are connected together and installed on the gun stock rearward end. The first end 17 of the support rod is inserted into the support tube 14 rearward end 15. The support rod second ends 18 attach to the butt plate 20. Preferably, two support tubes and two support rods are used, oriented in a parallel, horizontal fashion. In such an arrangement, the butt plate has a first end 21 and a second end 23, with a length extending between the first end 21 and the second end 23. The butt plate first end 21 attaches to the first tube system support rod end and the butt plate second end 23 attaches to the second tube system support rod end.

The rear surface of butt plate 20 rests/abuts against the right shoulder of a right-handed operator of the weapon. Thus, this distance from the butt plate to the trigger, can be adjusted by unlocking the locks 22 and sliding the support rods 16 into or out of the support tubes 14 until the proper distance is achieved, then the lock 22 can be locked down, thereby fixedly holding the selected length.

The hand-hold 6' in FIG. 2 (and the similar hand-hold embodiment 6" of FIG. 3) includes thumb hole 34 extending through the shoulder piece. This thumb hole 34 is formed and defined, at least in part, by the upper region 12 and first tube system on its top, the second tube system on its bottom, the hand-hold 6 at its front, and a hand-hold rear-extension 28 or insert 28' at its rear. This thumb hole 34 allows the operator to extend his or her thumb through the hole and grasp the weapon in a one-handed manner more easily, as shown in FIG. 3 in dashed lines. If an insert 28' is used, it is preferably flat and thin, and of such a length to give reasonable accommodation to provide an open space 29 for the use of locking means 22.

Figure 4:
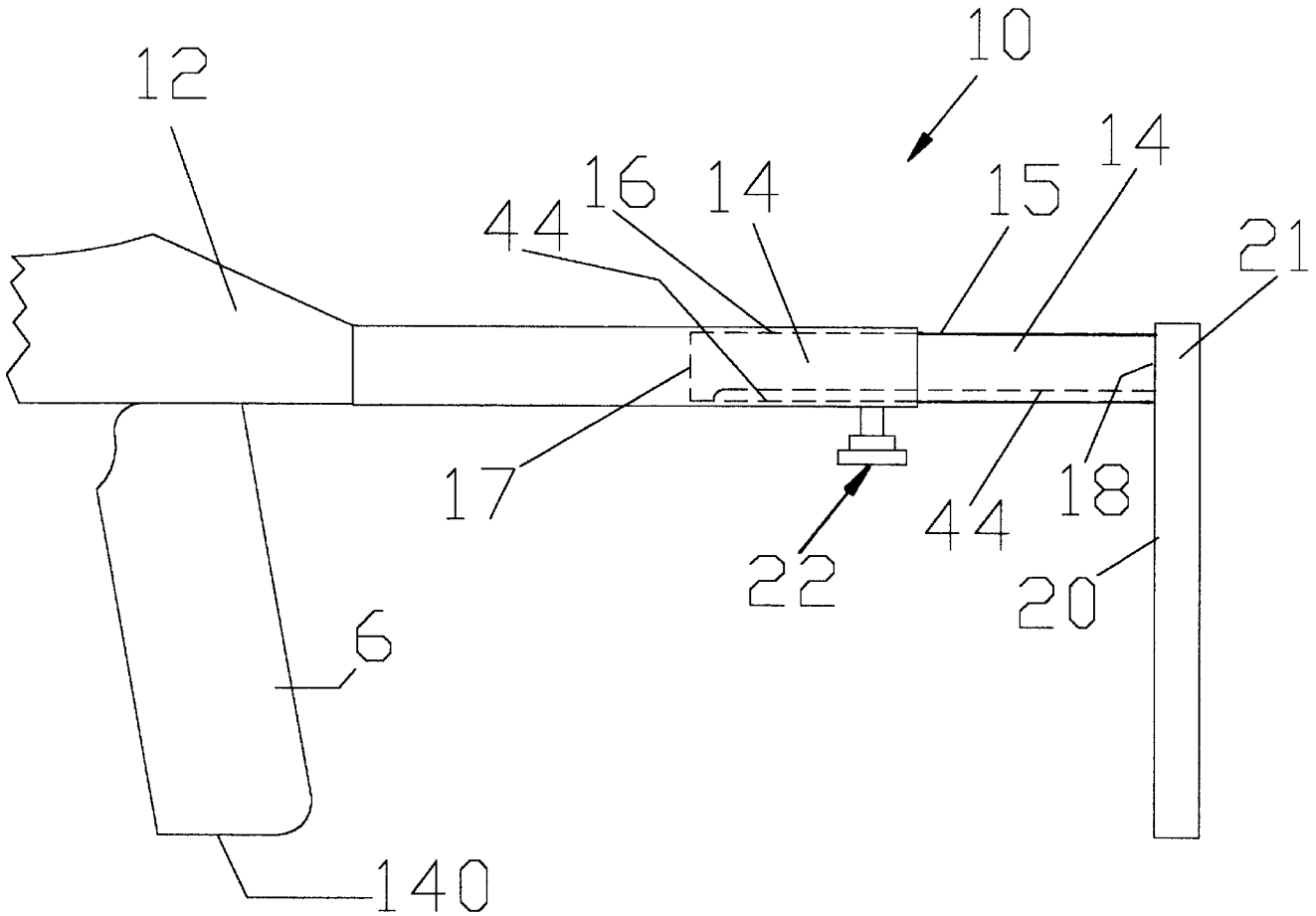
FIG. 4 is a side view of another embodiment of the invented extendible shoulder piece.

FIG. 4 shows a less-preferred embodiment 10' of the present invention, with a single tube system, that is, a single support tube 14, single rod 16, and single lock 22. The butt plate 20 is shown attached its first end 21 to the support rod second end 18. In this embodiment, the use of lock 22 tightening into groove 44 has the further benefit of keeping the rod (and attached butt plate 20) from rotating.

Figures 5A, 5B, 6:
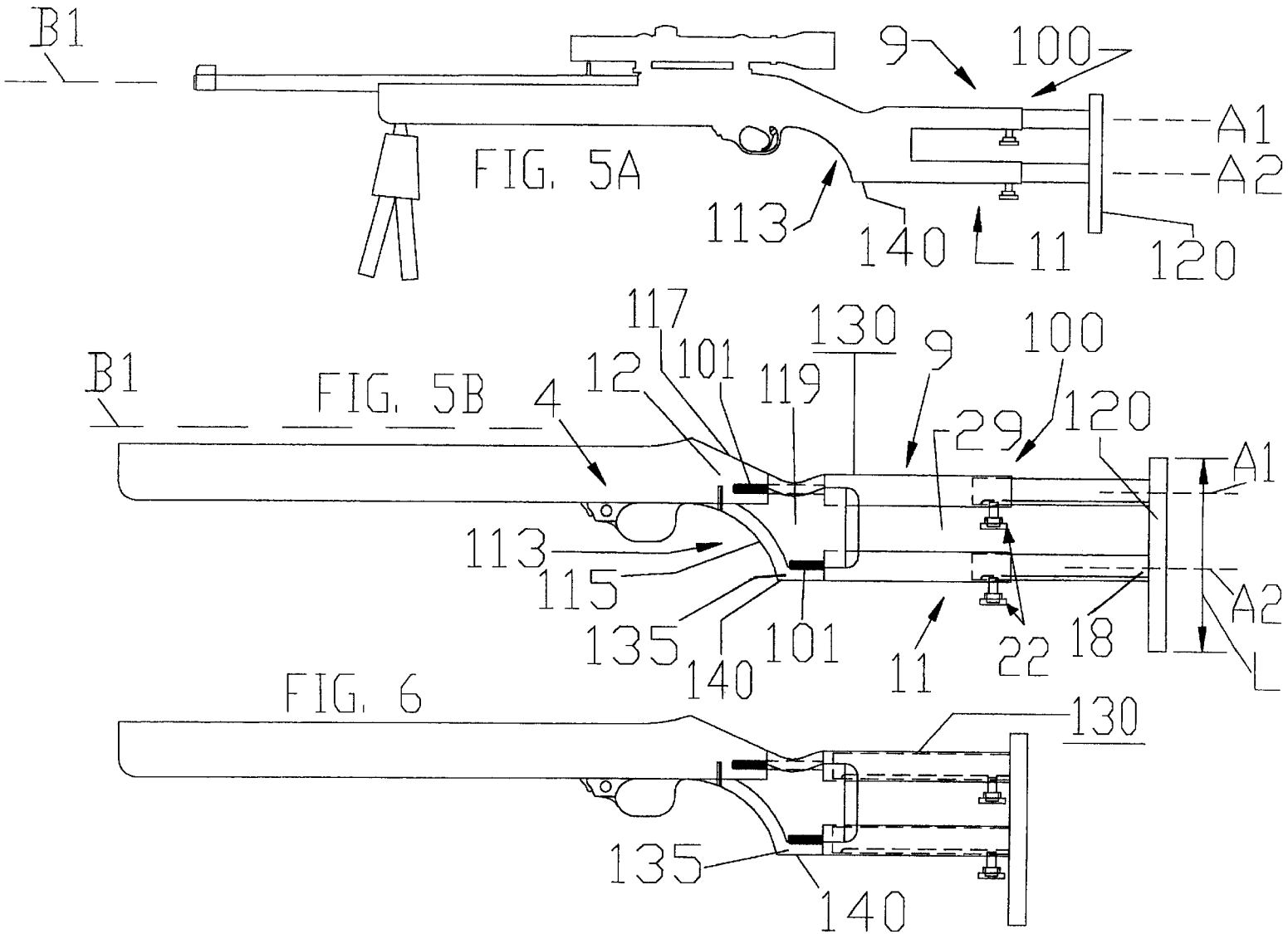
FIG. 5A is a side view of another embodiment of the invented extendible shoulder piece in an extended position and attached to a non-pistol-grip style weapon.
FIG. 5B is a side view of the embodiment in FIG. 5A, with details of attachment shown.
FIG. 6 is a side view of the weapon and invented extendible shoulder piece of FIGS. 5A and 5B, in a retracted position.

FIGS. 5A, 5B, and 6 illustrate an especially-preferred embodiment of a non-pistol-grip-style weapon with an extendible shoulder piece 100 installed on a shortened gun stock 4. FIGS. 7, 8A and 8B shown the shoulder piece 100 detached from the gun stock 4, suggesting how the hand-hold portion 106 is provided with the tube systems and butt plate, and then installed by a gun smith onto the gun stock. The shoulder piece 100 is preferably bolted onto the shortened stock 4 by means of bolts 101 or other fasteners, glue, or other attachment system. Preferably, one bolt 101 passes from the first tube system 9 through the hand-hold into the gun stock Preferably, another bolt 101 passes from the second tube system into the hand-hold.

In this embodiment, the grip portion 113 gradually curves downward and rearward from the rear end of the shortened stock, wherein the lower curved surface 115 of the grip portion 113 accepts the curled fingers of the user, and the upper curved surface 117 accepts the thumb of the user. The forward area 119 between the first tube system 9 and second tube system 11 may therefore be generally solid as the hand need not extend through that area. Behind area 119, however, open space 29 is still preferred for reaching locks 22. In this embodiment, one may see that the bottom edge of the butt plate 120 extends below the second tube system to increase the length L of the butt plate for stabilization. While the bottom edge may extend, in some embodiments, about 1–2 inches below the lower tube system's rear end, the lower tube system is still considered to be "near" the bottom edge of the butt plate.

Preferably, whether installed on a pistol-style or non-pistol-style grip, the connection of the butt plate to the grip portion is done so that the upper surface 130 of the shoulder piece is slightly below the longitudinal axis of the barrel, so that the user may place his/her cheek on the upper surface 130 and use it as a cheek rest during aiming and shooting. The connection is also preferably designed to extend as far down on the weapon as possible, to maximize the distance from the upper connector to the lower connector. This translates, in most embodiments, to the first tube system being connected to and extending rearward from the rear end of the shortened stock, on an axis A1 that is slightly below the barrel axis B1, wherein axis A1 is also, therefore, slightly below the top horizontal surface of the gun stock. In the embodiment shown in FIGS. 5A–8C, the longitudinal axis of the upper connector is about 1.2 inches lower than the top of the gun stock (see FIG. 8C). Preferably, axis A1 is in the range of about 1.0–1.5 inches lower than the top of the gun stock, as this places, for many weapons, the top surface of the connector at a position distanced from the sights about This translates, in most embodiments, to the second tube system being connected to and extending rearward from the lowermost end 135, that is, the lower extremity, of the grip portion. Thus, the second tube system longitudinal axis A2 is preferably parallel to and on, or nearly on, the same elevation/level as the bottom surface 140 of the grip portion. By "nearly on the same elevation" or "nearly on the same level" is meant that the axis A2 is within about ½ inch of the bottom surface 140, and more preferably, about 7⁄16 inch from the bottom surface 140 (see FIG. 8C). Most preferably, the second tube system has a lower surface that is at the same level as the bottom surface 140. Placing the lower, second tube system 11 as low as possible on the grip portion (rather than extending rearward from midway on the hand-hold 6, or from even higher on the grip portion) serves an important function of maximizing the vertical distance between the preferred two connectors (system 9 and system 11), while still placing the cheek rest surface 130 properly for sighting and/or shooting. A greater distance between the two connectors is easier to achieve in the pistol-grip style, because the hand-hold 6 extends more perpendicularly down from the longitudinal axis of the firearm, and, therefore, the bottom surface of the grip portion is farther down. In the embodiment of FIGS. 5A–8B, the distance between the upper, first tube system 9 and the lower, second tube system 11 is less, but the distance D is still maximized for the particular weapon style, that is, typically about 1½ inches for the embodiment of FIGS. 5A–8C. In such an embodiment, the butt plate 120 is lengthened, as described above, to provide a longer abutment surface for the butt plate against the shoulder.

FIGS. 1, 2, 5A, 9, and 10 shows a bipod 30 for attaching to the forward end of the stock 4, including a bipod attachment means 32. This bipod attachment means 32 attaches to the underside of the stock 4 so that a bipod 30 may be attached to the weapon.

Figure 9:
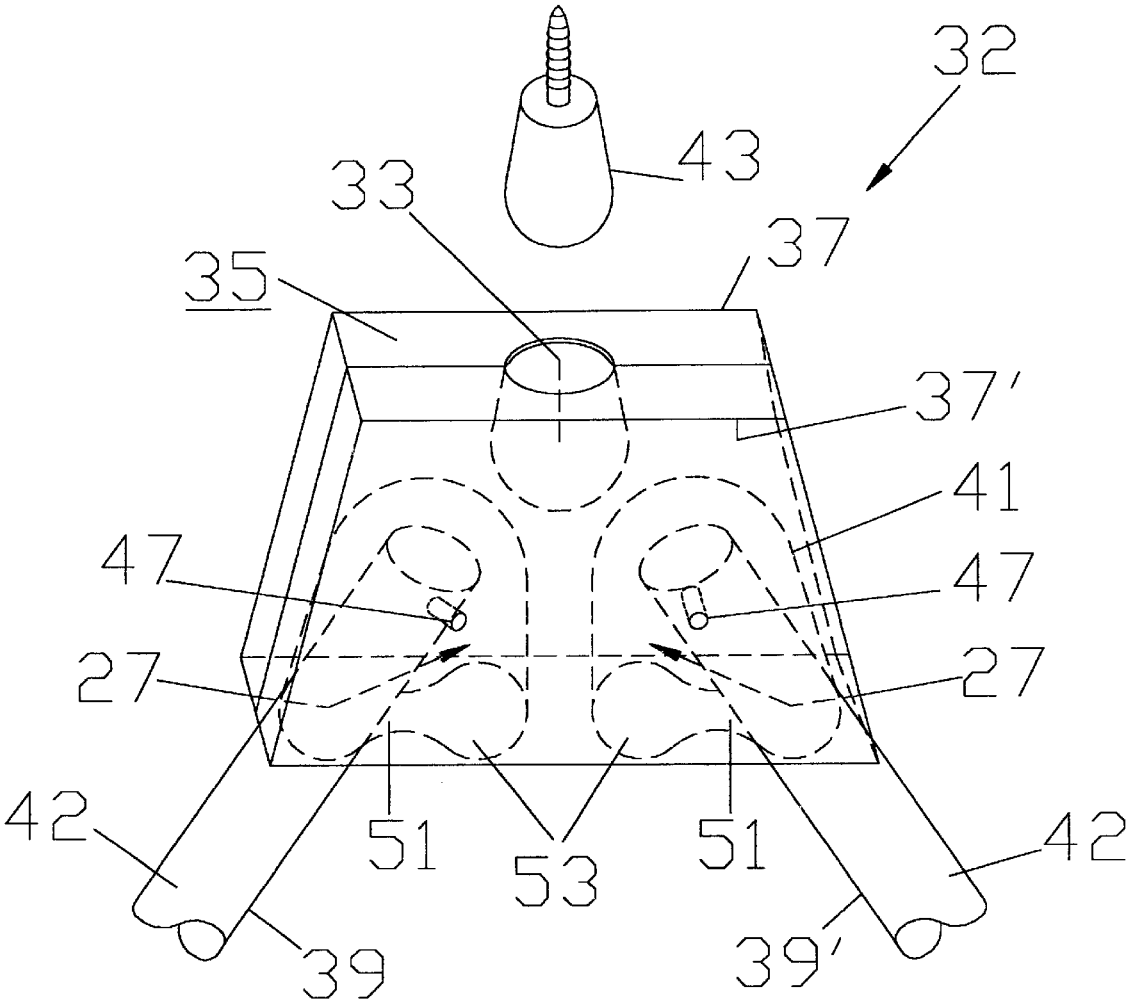
FIG. 9 is a partial perspective view of one embodiment of the invented bipod.
Figure 10:
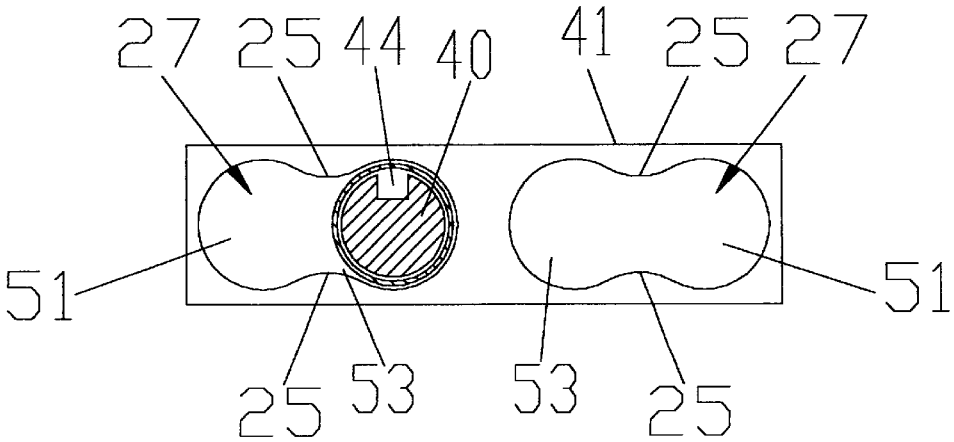
FIG. 10 is a bottom view of the main body of the bipod of FIG. 9, shown with one bipod leg in cross-section in an inward position.

The bipod attachment means 32, in the preferred embodiment, comprises a ball knob 43, a mount or bipod body 41, and a pair of bipod legs 39, 39'. The preferred embodiment of bipod attachment means 32 is shown in FIGS. 9 and 10. The knob or ball 43 is attached to the bottom of the weapon, so that the rounded portion of the knob 43 extends downward. The preferred mount or bipod body 41 is comprised of a pair of separate shells 37, 37' fastened together, however, single piece mounts are also envisioned. The top surface 35 of the mount 41 further comprises a recess called the knob socket 33. The internal surface of the knob socket 33 has a circular opening or entrance of a diameter slightly smaller than the outer diameter of the knob 43. The bipod attachment means 32 is preferably made of a resilient material, such as the preferred materials nylon or UHMW-poly. This allows the knob 43 to be inserted into the socket 33, through the entrance, in a snap-fit fashion. Once the knob 43 is in the socket 33, it can swivel and move inside the socket 33. This ball and socket joint is releasably attachable and detachable by a user, allowing a user to easily snap the bipod onto and off of the weapon, wherein the ball is permanently or semi-permanently installed on the weapon, and the socket of the bipod is used when desired.

The bipod legs 39,39' attach inside the mount 41 in a pivotable relationship, able to swing on a pivot axis 47, so that each leg can snap between a distanced position (shown in FIG. 9 with the legs in the outer lobes 51) and a closed position when the legs are snapped into the two inner lobes 53 of the leg guide holes 27. FIG. 10 shows the bottom surface 31 of the mount 41, wherein the leg guide holes 27 with outer lobes 51 of the holes 27 and inner lobes 53 of the holes 27. Alternatively, there may be more than two guide holes 27 if there are more than two legs, or each of the guide holes 27 may include more than two lobes, for example, for incremental movement of the legs into various positions. However, the preferred version has two legs and two guide holes with only a fully-opened position (outer lobes 51) and a fully-closed position (lobes 53).

In the preferred embodiment, each of the guide holes 27 is made from two circular channels or orifices that extend through the bottom surface 31 into the mount 41, wherein the two circular channels (which form lobes 51, 53) are open to each other and come closer together at their upper ends. Where the adjacent orifices or "lobes" slightly overlap, they form protrusions or "nubs" 25 that protrude into the guide holes 27 to form the resistance to the legs snapping between the lobes 51, 53. The distance between facing nubs 25 is preferably slightly smaller than the outside diameter of the bipod tubes 42. These nubs 25 are formed of a resilient material so that the tubes 42 can by snapped from the inside orifices (lobes 53) to the outside orifices (lobes 51) and, in reverse, from the outside orifices into the inside orifices. The ability of snapping both legs 39, 39' into the inside position (the tubes 42 in the inside orifices of "lobes" 53) allows for compact storage of the bipod with the legs together.

The ball/socket joint attaches the bipod 30 to the stock 4 and allows the weapon 2 to be leveled about the bore axis as well as allowing several degrees of angle adjustment to the level of the barrel, wherein the shooter leaves the bipod leg feet fixed on the ground and tilts the gun forward or backward, as well as adjustment for panning deflection. The bipod 30 thus has two methods of height adjustment, the set screws or pins for rough adjustment, and the rocking and tilting action forward or backward, side to side, with the feet of the bipod resting on the ground for fine adjustment.

The bipod 30 is able to be adjusted for height so that users of different height can use the bipod, or for use in a standing, seated, or prone position. The preferred embodiment of bipod is shown in FIG. 2, and has a bipod rod 40 which telescopingly engages a bipod tube 42. A thumb screw 38 is inserted through a lock hole in the bipod tube 42 and cooperates with a slot running the length of the rod 40 to lock the bipod rod 40 within the bipod tube 42 at selectable heights. Other adjustment/locking means are also envisioned.

In use, the user holds up the rifle, either through their own power or through assistance of another individual. Then the support rod or rods are slid out of the support tubes the proper distance so the individual will be able to hold the weapon in the proper firing position with hand near the trigger. The proper distance is one which allows the user to operate the weapon and is comfortable for the operator. When this distance is determined, the operator (or his/her assistant) can tighten down the locking means, thereby locking the shoulder piece length.

When the bipod is being used to help as part of a training system for an adult teaching an adolescent, the adult can take the weapon, set the proper distance between the adolescent's shoulder and the butt plate, lock down the locking means, attach the gun to the bipod, and adjust the bipod to the appropriate height. Then the adult merely has to supervise the adolescent as the weapon is fired. Without use of such a bipod, in order for adolescents to learn how to shoot, either the adult will be required to hold up the forward end of the gun (which the adolescent does not have the arm length or strength to support), or the adolescent is required to lay prone with the forward end of the gun resting upon an object.

Because most children are not of a size and strength sufficient to handle the average weight of a typical rifle, a right-handed child would also be able to grasp the bottom support tube member with their left hand and thereby steady the gun located on the bipod. Such a right-handed user would then place their hand on and around the hand-hold member with their finger at or near the trigger. This is especially helpful when the user does not have arm length sufficient to reach the forward portion of the stock for support of the stock. This format would also work well for left-handed shooters using their opposite hands in a likewise manner.

It is preferred that the bipod only allow minimal movement within the horizontal plane of the rifle or weapon. This would keep an inexperienced user from swinging the firing end of the weapon around in the direction of others. This would allow an adult supervisor to set the rifle down pointed in a proper direction, and have some confidence that the child using the gun will not be likely to turn the gun to be facing other individuals.

The easy adjustability of the present invention allows an adult or other individual to change the gun butt distance quickly and easily, thereby allowing multiple individuals to use the same gun.

The present invention can be sold either as a replacement stock incorporating the improved shoulder piece, or may be sold as a stand alone kit for attachment to a weapon by a handy operator.

The shooting system of the invention includes the steps of taking a firearm having such an improved gun stock and adjusting the gun stock to the proper pull length (length of pull from trigger guard to stock butt). Once the proper pull length is determined and set, the firearm can be set upon the bipod. The bipod is then adjusted to the proper height for the person using the weapon and his/her position. The person is then able to use the weapon with the bipod supporting the front of the weapon and the adjustable shoulder piece allowing the user to more comfortably and properly the gun having proper trigger pull distance.

Although this invention has been described above with reference to particular means, materials and embodiments, it is to be understood that the invention is not limited to these disclosed particulars, but extends instead to all equivalents within the scope of the following claims.

I claim:

1. A weapon having extendible shoulder piece, the weapon comprising:

a barrel with a barrel longitudinal axis;

a gun stock with a front end, a rear end, a gun stock longitudinal axis, and with a grip portion extending generally downward from the longitudinal axis of the gun stock, the grip portion having an upper region and a lower portion for a user's fingers to grasp, the lower portion having a lowermost extremity;

an extendible shoulder piece extending from the gun stock, the extendible shoulder piece comprising a butt plate with a top edge and a bottom edge, and a plurality of connectors that are adjustable in length and that connect the butt plate to the grip portion of the gun stock to that the butt plate is moveable to a retracted position close to the gun stock and moveable to a extended position away from the gun stock, said plurality of connectors comprising an uppermost connector and a lowermost connector;

a lock system adapted to lock said plurality of connectors in an adjusted position during shooting of the weapon to prevent collapse and extension of the plurality of connectors in relation to each other as the weapon fires. thereby fixedly holding the extendible shoulder piece at a selected length; and wherein the plurality of connectors are adjustable in length continuously between the retracted position and the extended position and said lock system is adapted to lock the plurality of connectors in any of a number of positions arranged continuously between said retracted position and said extended position;

wherein the uppermost connector is connected to and extends rearward from the upper region of the grip portion and has a longitudinal axis generally parallel to, and below, the barrel longitudinal axis, wherein the upper most connector has a top surface positioned for being a cheek rest for a user during sighting and shooting;

wherein the lowermost connector is generally parallel to the uppermost connector, and the lowermost connector is connected to and extends rearward from said lowermost extremity of the grip portion, so that the uppermost connector and lowermost connector are vertically distanced and the lowermost connector is as low as possible on the grip portion;

wherein the uppermost connector and lowermost connector are generally parallel and have rear ends that are distanced from each to attach to the butt plate near said butt plate top edge and bottom edge for stabilizing the butt plate connection to the gun stock.

2. A weapon as in claim 1, wherein each of the plurality of connectors are telescoping tube systems.

3. A weapon having extendible shoulder piece, the weapon comprising:

a barrel with a barrel longitudinal axis;

a gun stock with a front end, a rear end, a gun stock longitudinal axis, and with a grip portion extending generally downward from the longitudinal axis of the gun stock, the grip portion having an upper region and a lower portion for a user's fingers to grasp, the lower portion having a lowermost extremity;

an extendible shoulder piece extending from the gun stock, the extendible should piece comprising a butt plate with a top edge and a bottom edge, and a plurality of connectors that are adjustable in length and that connect the butt plate to the grip portion of the gun stock to that the butt plate is moveable to a retracted position close to the gun stock and moveable to a extended position away from the gun stock, said plurality of connectors comprising an uppermost connector and a lowermost connector;

wherein the uppermost connector is connected to and extends rearward from the upper region of the grip portion and has a longitudinal axis generally parallel to, and below, the barrel longitudinal axis, wherein the upper most connector has a top surface positioned for being a cheek rest for a user during sighting and shooting;

wherein the lowermost connector is generally parallel to the uppermost connector, and the lowermost connector is connected to and extends rearward from said lowermost extremity of the grip portion, so that the uppermost connector and lowermost connector are vertically distanced;

wherein the uppermost connector and lowermost connector are generally parallel and have rear ends that are distanced from each to attach to the butt plate near said butt plate top edge and bottom edge for stabilizing the butt plate connection to the gun stock;

wherein said bottom edge of the butt plate extends about 1–2 inches below the rear end of the lowermost connector.

4. An extendible shoulder piece for connection to a weapon, the weapon having a short gun stock with a front end, a rear end, and a gun stock longitudinal axis and having a barrel with a barrel longitudinal axis, wherein the extendible shoulder piece comprises:

a butt plate with a top edge and a bottom edge;

a hand-hold member for attachment to the rear end of the short gun stock, the hand-hold member being for a user's fingers to grasp, and the hand-hold member having a top side and a lowermost extremity;

an upper connector and a lower connector connecting the butt plate to the hand-hold member, the upper connector and lower connector being adjustable in length to move the butt plate to a retracted position close to the gun stock and to move the butt plate to a extended position away from the gun stock, the upper connector and the lower connector being attached to the butt plate near the top edge and near the bottom edge of the butt plate, respectively;

wherein the upper connector is attached to the hand-hold member near said top side and the lower connector is attached to and extends rearward from the lowermost extremity of the hand-hold member, so that the upper connector and lower connector are distanced from each other a maximum amount; and wherein the upper connector has an upper surface and the upper connector is attached to the gun stock at a level below the barrel longitudinal axis so that the upper connector upper surface is a cheek rest.

5. An extendible shoulder piece as in claim 4, wherein the upper and lower connectors are adjustable in length and comprise locks for locking each of said connector at a desired length.

6. An extendible shoulder piece as in claim 5, wherein the upper connector and the lower connector are each telescoping tube systems.

7. An extendible shoulder piece as in claim 5, wherein upper connector and lower connector are distanced apart to form and define an open space between said upper connector and lower connector, and wherein at least one of said locks is located in the open space and is accessible by a user through the open space.

8. An extendible shoulder piece for connection to a weapon, the weapon having a short gun stock with a front end, a rear end, and a gun stock longitudinal axis and having a barrel with a barrel longitudinal axis, wherein the extendible shoulder piece comprises:

a butt plate with a top edge and a bottom edge;

a hand-hold member for attachment to the rear end of the short gun stock, the hand-hold member being for a user's fingers to grasp, and the hand-hold member having a top side and a lowermost extremity;

an upper connector and a lower connector connecting the butt plate to the hand-hold member, the upper connector and lower connector being adjustable in length to move the butt plate to a retracted position close to the gun stock and to move the butt plate to a extended position away from the gun stock, the upper connector and the lower connector being attached to the butt plate near the top edge and near the bottom edge of the butt plate, respectively;

wherein the upper connector is attached to the hand-hold member near said top side and the lower connector is attached to and extends rearward from the lowermost extremity of the hand-hold member, so that the upper connector and lower connector are distanced from each other a maximum amount; and wherein said bottom edge of the butt plate extends about 1–2 inches below the rear end of the lower connector.

9. An extendible shoulder piece as in claim 4, which is provided as a separate unit kit for installation on a weapon after the gun stock of the weapon is shortened.

10. An extendible shoulder piece for connection to a weapon, the weapon having a short gun stock with a front end, a rear end, and a gun stock longitudinal axis and having a barrel with a barrel longitudinal axis, wherein the extendible shoulder piece comprises:

a butt plate extending generally perpendicularly to the gun stock longitudinal axis, the butt plate having a top edge and a bottom edge;

a hand-hold member for attachment to the rear end of the short gun stock, the hand-hold member being for a user's fingers to grasp, and the hand-hold member having a top side and a lowermost extremity;

an upper connector and a lower connector connecting the butt plate to the hand-hold member, the upper connector and lower connector extending generally parallel to the gun stock longitudinal axis and being adjustable in length to move the butt plate to a retracted position close to the gun stock and to move the butt plate to a extended position away from the gun stock, the upper connector and the lower connector being attached to the butt plate near the top edge and near the bottom edge of the butt plate, respectively;

wherein the upper connector is attached to the hand-hold member near said top side so that an upper surface of the upper connector is positioned at a level below the barrel longitudinal axis for being as a cheek rest for the user; and wherein the lower connector is attached to and extends rearward from the lowermost extremity of the hand-hold member to maximize the distance of the lower connector from the upper connector;

wherein the upper connector and lower connector are continuously-adjustable telescoping tube systems, and wherein:

the upper connector comprises a support tube and a support rod slidably received in the support tube;

the support rod has a length and comprises an elongated groove along its length with a groove surface;

the upper connector comprises a threaded member extending through the support tube and adapted to screw down into the groove to en the groove surface, so that the support rod is lockable at longitudinally adjustable positions arranged continuously in the support tube.

11. An extendible shoulder piece as in claim 10, wherein the support rod has a front end and the groove terminates before the support rod front end, to prevent the threaded member from sliding entirely out of the support tube.

12. An extendible shoulderpiece as in claim 10, wherein:

the lower connector comprises a lower connector support tube and a lower connector support rod slidably received in the lower connector support tube;

the lower connector support rod has a length and comprises an elongated groove along its length with a groove surface;

the lower connector comprises a threaded member extending through the lower connector support tube and adapted to screw down into the groove to engage against the groove surface, so that the lower connector support rod is lockable at longitudinally adjustable positions arranged continuously in the lower connector support tube.

* * * * *